United States Patent [19]

Goudey

[11] 4,358,146

[45] Nov. 9, 1982

[54] RELEASE MECHANISM

[75] Inventor: Clifford A. Goudey, Charlestown, Mass.

[73] Assignee: Massachusetts Institute of Technology, Cambridge, Mass.

[21] Appl. No.: 230,753

[22] Filed: Feb. 2, 1981

[51] Int. Cl.³ ..... B66C 1/36

[52] U.S. Cl. ..... 294/84

[58] Field of Search ..... 294/75, 83 R, 83 A, 294/84; 24/241 PP, 241 SB; 114/252

[56] References Cited

U.S. PATENT DOCUMENTS 1,242,809 10/1917 Irwin ..... 294/83 R
3,167,345 1/1965 Dukes ..... 294/83 R
4,201,410 5/1980 Crawford et al. ..... 294/83 R

FOREIGN PATENT DOCUMENTS 599461 3/1948 United Kingdom ..... 294/83 A
1182603 2/1970 United Kingdom ..... 294/83 R

*Primary Examiner*—Johnny D. Cherry
*Attorney, Agent, or Firm*—Arthur A. Smith, Jr.; Leo R. Reynolds

[57] ABSTRACT

A release mechanism which is releasable from the direction of the load and requires that two levers be pulled in sequence and held from the direction of the load for release. Hook-up may be achieved manually with one hand.

10 Claims, 5 Drawing Figures

RELEASE MECHANISM

The Government has rights in this invention pursuant to Contract Number NA79AA-D-00101 awarded by the National Oceanic and Atmospheric Administration.

DESCRIPTION

Technical Field

This invention is in the field of release mechanisms and in particular a release hook for a single point lift device utilized, for example, to hoist lifeboats.

Background Art

For many years now, the maritime industry has been plagued with accidents involving the deployment of lifeboats into the water. A principle factor in these accidents is the hookup mechanism in current use. This mechanism comprises a gated hook which is manually rotated ninety degrees by the operator who then manually inserts or releases the load ring. This is a two-handed operation and requires unweighting of the load (the lifeboat) before it can be released. This means that the lifeboat must be lowered into the water before it can be unhooked or released. Also, any change in the load could cause injury to the operator while attempting to release or lock the gate.

Accordingly, it would be desirable to have a hook-up mechanism capable of being released without being unloaded, i.e., having a release under load capability. While many connecting devices exist with release under load capabilities, for various reasons such devices have not been found satisfactory to the maritime industry. One problem with such a feature is that the possibility of inadvertent release is now present. Accordingly, means must be devised to prevent accidental or inadvertent release.

At the same time, it would be highly desirable to provide a simple, safe, and quick hook-up means which may be manually operated using one hand.

Disclosure of the Invention

In the apparatus of the present invention, a release mechanism is provided in the form of an elongate body which may be suspended at one end from a hoist mechanism. The other end of the body has a slot portion which is sufficiently long to accept a hook-up ring from an external load, such as a lifeboat.

A pivotable load bearing gate is provided across this slot and biased to move away from the slot by an extension spring. The gate is held across the slot (in the locked position) by a pivotable catch lever. The catch lever, in turn, is held engaged with the gate by a pivotable release lever which is biased by a compression spring to engage the catch lever. The release lever is likewise held engaged with the catch lever by a pivotable safety lever biased by an extension spring to engage with the release lever.

In operation, the hook-up ring from the load is simply inserted in the slot by urging the ring up the slot against the gate. The gate exerts an opposing force, until the ring has been inserted far enough so that the gate may move back across the slot and through the center of the ring. The hook-up ring is now locked.

When it is desired to release the load by freeing the hook-up ring from the slot, the safety lever must be pivoted first to unlatch the release lever. The safety lever must also be held in the unlatched position while the release lever is then pivoted to the unlatched position. In the preferred embodiment of the invention, the direction in which the safety lever and release lever are pivoted for unlatching is made the same and the direction of pull is from the load side so that separate lanyards tied to each lever may be pulled from the load side to effect release of the load. This makes it relatively easy to release a lifeboat or other vessel from a hoist by a person in the lifeboat. The fact that both levers must be pivoted and the safety lever continually held unlatched in order to release the hook-up ring makes accidental or inadvertent release improbable. Furthermore, the hook-up ring may be released while under load thereby eliminating the source of many accidents, for example, in connecting or disconnecting lifeboats.

BEST MODE OF CARRYING OUT THE INVENTION

Figure 1:
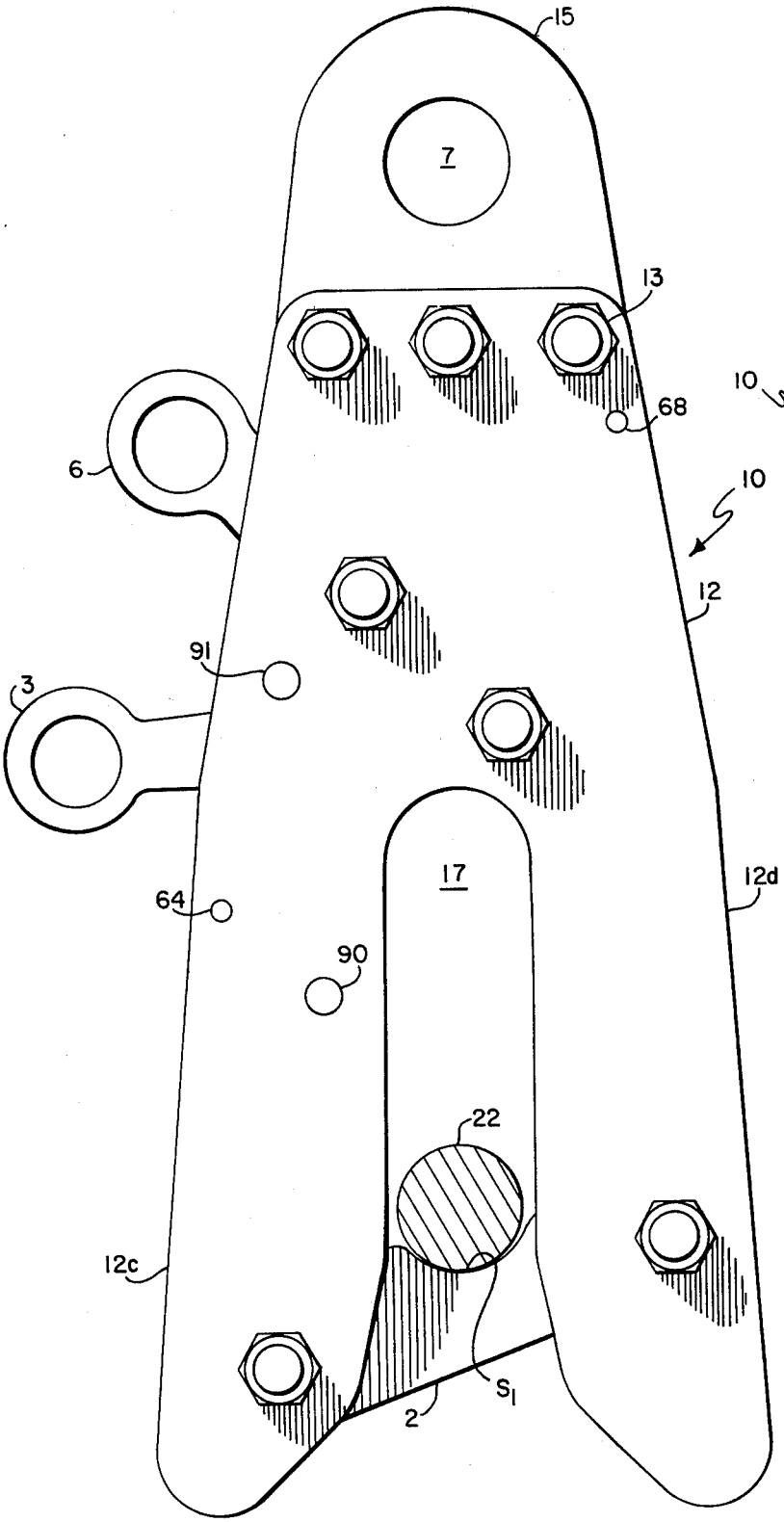
FIG. 1 is a top view of a release mechanism in accordance with the invention.
Figure 2:
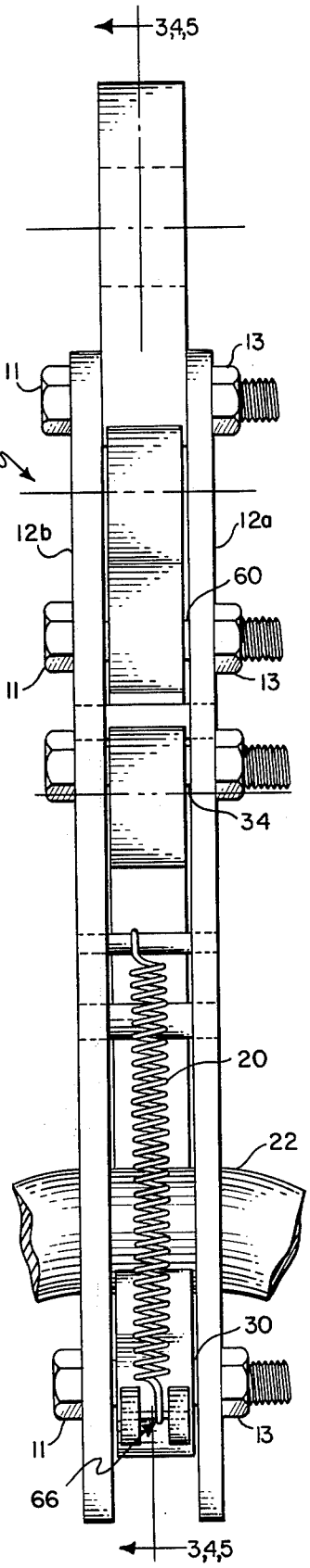
FIG. 2 is a side view of the release mechanism of FIG. 1.

Referring now to FIGS. 1–5, the release mechanism 10 of the invention has a generally elongate Y-shaped body 12 consisting of two rigid plates 12*a* and 12*b*. The two plates are spread apart by spacers 30, 32, 34, and 60 and suspension member 15. Spacers 30, 32, 34, and 60 also serve as pivotal bearing for levers 1, 2, 3 and 6. Member 15 has an opening 7 to accommodate a hoist cable (not shown) such that the release mechanism 10 may be suspended at this end from a hoist. Bolts 11 and nuts 13 secure the two plates 12*a* and 12*b* together, attach member 15 and locate spacer/bearings 30, 32, 34, and 60.

A gate member 2 is pivotally attached between places 12*a* and 12*b* on bearing 30 at one leg 12*c* of the Y-shaped body 12. A slot 17 is formed between the two legs of body 12 for a sufficient distance to accept hook-up ring 22. The entrance to the slot is tapered to facilitate entry. Gate member 2 is a bar-like load bearing member having a concave surface "S" centrally located at the interior slot side of gate member 2 when the gate is latched. Gate 2 also has a flat latching surface $L_1$ (see FIGS. 3–5) at one end thereof which is adapted to fit into opposing catch surface $C_1$ of catch lever 1. Gate 2 is biased to move in the direction of arrow A of FIG. 5 by extension spring 20 suspended between pin 64 and bracket 66.

Catch lever 1 is pivotally mounted on bearing 32 on the other leg 12*d* of body 12 between plates 12*a* and 12*b*. One end of catch lever 1 has a catch surface $C_1$ which interfits with the latch surface $L_1$ on gate 2 as previously noted.

The other end of lever 1 has a convex latch surface $L_2$ which interfits with a corresponding concave catch surface $C_2$ on one side of release lever 3. Release lever 3 is pivotally mounted on bearing 34 located above the closed end of slot 17 between plates 12*a* and 12*b*. Lever 3 is biased in the latched position shown in FIG. 3 by compression spring 50 which is fixed at one end by stop 52 and concentrically mounted on button 54 of lever 3.

The side of lever 3 opposite catch surface $C_2$ has a catch surface $C_3$ which mates with the respective latch surface $L_3$ of safety lever 6. Safety lever 6 is pivotally mounted on bearing 60 between plates 12*a* and 12*b*.

Figure 5:
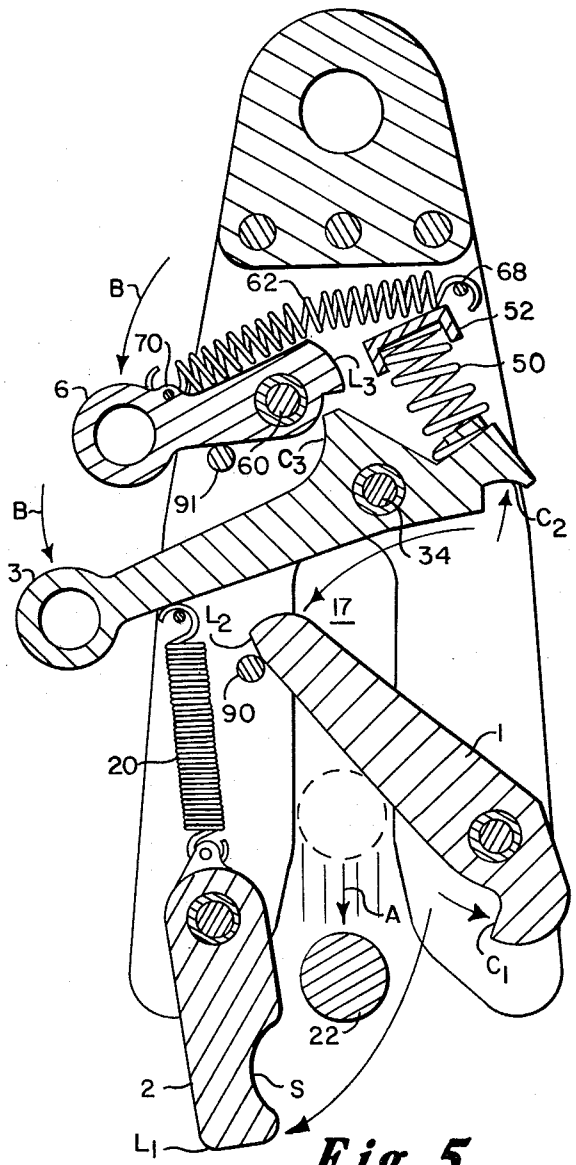
FIG. 5 is a sectional view along lines 5—5 of FIG. 2 with both the safety lever and release lever actuated.

Safety lever 6 is biased in the latched position as shown in FIG. 5 by extension spring 62 suspended between pin 68 and bracket 70.

Figure 4:
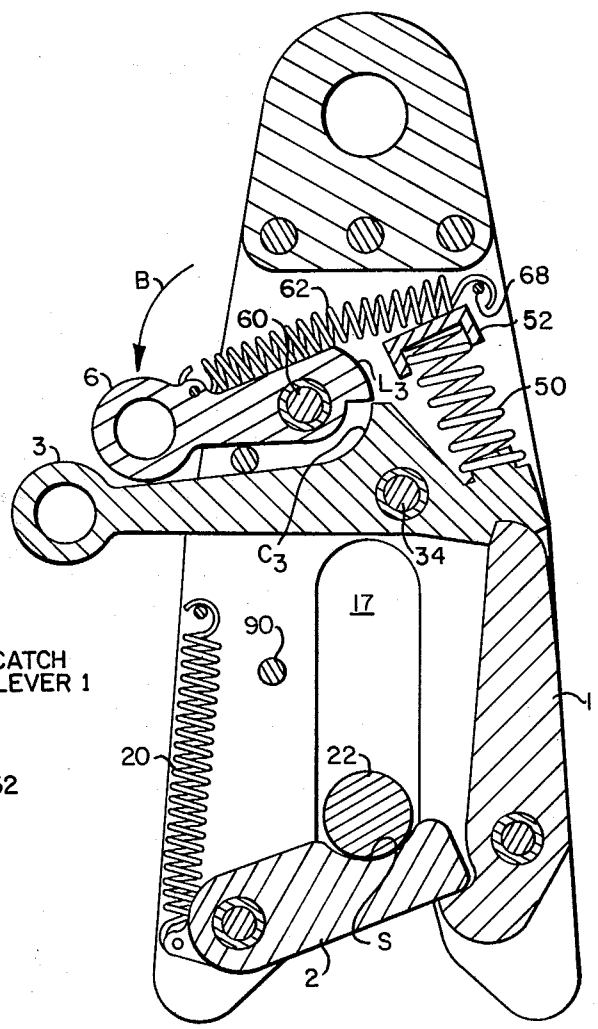
FIG. 4 is a sectional view along lines 4—4 of FIG. 2 with the safety lever actuated.
Figure 3:
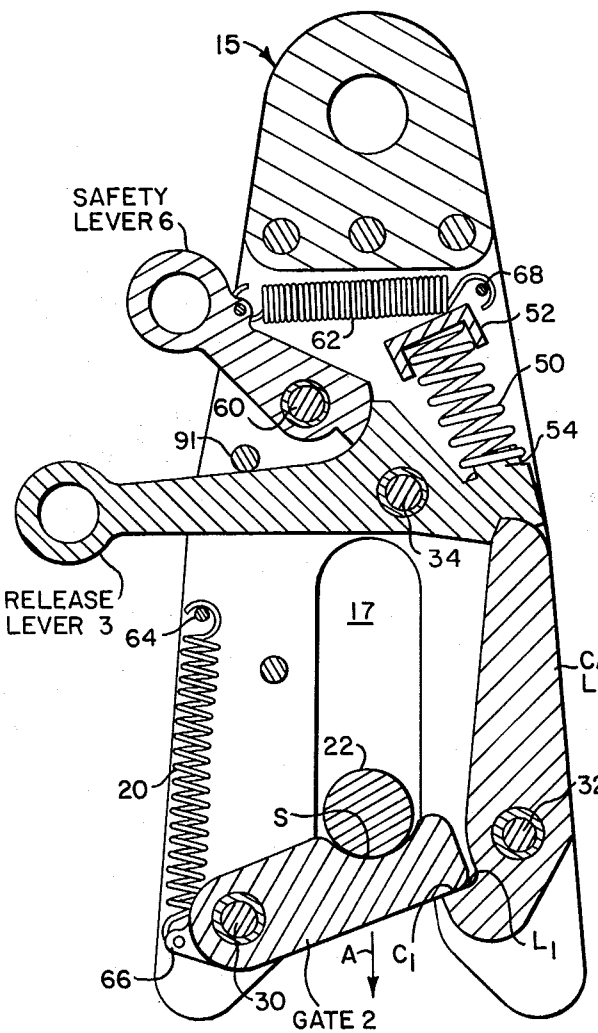
FIG. 3 is a sectional view along lines 3—3 of FIG. 2 with both the safety lever and release levers latched.

Having thus described the release mechanism 10 in a static condition we now refer to FIGS. 3–5 which show the operation of the unit in the normal latched position (FIG. 3) and next as the safety lever 6 is depressed in the direction of arrow B (FIG. 4) and finally (FIG. 5) as both levers 6 and 3 are moved in the direction of arrows B.

First, with the apparatus disposed as shown in FIG. 3, a ring 22 (one section of which is shown) may be passed into slot 17 a sufficient distance until gate 2 under the bias force of spring 20 snaps back in the direction of arrow A and retains the ring on surface S. The gate 2 is retained across the slot by the engagement of opposing surfaces $L_1$ and $C_1$ on gate 2 and lever 1 respectively. Thus, it may be seen that ring 22 may be locked in place by a simple one-handed manual movement in one direction.

Next, in order to release the ring 22, two things must happen in the correct sequence. The first sequence is to move lever 6 in the direction B, for example, by pulling on a lanyard (not shown) tied to the opening in lever 6. This movement disengages surfaces $L_3$ and $C_3$ of respective levers 6 and 3, thereby enabling lever 3 to be moved in the direction of arrow B. If, however, lever 6 is released before lever 3 is moved in the direction B, surfaces $L_3$ and $C_3$ re-engage and lever 3 cannot be depressed (moved in direction B). When lever 3 is moved in direction B, as in FIG. 5, surfaces $C_2$ and $L_2$ are disengaged, whereupon lever 1 is free to rotate and does rotate under the influence of gate 2 due to the influence on gate 2 of bias spring 20 or the load of ring 22 resulting in ring 22 becoming unhooked. Pin 90 prevents lever 1 from rotating beyond a position necessary for release and possibly damaging extension spring 20. Pin 91 prevents lever 3 from pivoting beyond a position necessary for engagement with lever 1 which might allow the loss of compression spring 50. Pin 91 also prevents lever 6 from pivoting beyond a position necessary for disengagement with lever 3 and striking the outer end of lever 3 resulting in premature release of the load.

The materials used in the invention should be sufficiently strong and resistant to salt spray to survive the environment. Typically, stainless steel or brass is employed throughout for structure members.

This completes the description of the preferred embodiment of the invention. Those skilled in the art may recognize other equivalents to this specific embodiment, which equivalents are intended to be encompassed by the claims attached hereto. For example, in large production quantities, it may be desirable to fabricate the non-moving parts of the device 10 as an integral body rather than as separate pieces, as previously described.

I claim:

1. Apparatus comprising:

(a) an elongate generally Y-shaped body in which the two legs of the Y form a slot portion adapted to accept a hook-up ring from an external load;

(b) a pivotable gate load bearing member adapted to pivot in and across said slot and having a latch surface at one side of said gate;

(c) bearing means urging said gate to pivot away from the slot whereby said ring may be hooked-up by sliding the ring in the slot past the gate;

(d) a pivotable catch lever having (i) a catch surface at one end of said lever adapted to oppose the latch surface of said gate to latch said gate across said slot and (ii) a latch surface at another end of said lever;

(e) a pivotable release lever having (i) a first catch surface on one side adapted to oppose the latch surface of the catch lever and (ii) a second catch surface on another portion of said lever;

(f) a pivotable safety lever having a latch surface adapted to engage the second catch surface of the release lever;

(g) biasing means biasing said release lever and safety lever toward a position in which opposing catch and latch surfaces are engaged.

2. The apparatus of claim 1 wherein the legs are tapered at the entry to the slot portion.

3. The apparatus of claim 1 in which the release lever and safety lever are adapted to be pivoted from the slot end of the body to release the hook-up ring.

4. The apparatus of claim 3 in which the release lever cannot be pivoted unless the safety lever is pivoted first and held in a pivoted position against the direction in which it is biased.

5. The apparatus of claim 3 in which the gate member is mounted on one leg of the Y and the catch lever on the other leg of the Y.

6. A release mechanism comprising:

(a) a slotted body member;

(b) a gate member;

(c) a catch lever;

(d) said gate member being pivotally supported on said body member adjacent the slot so that said gate member closes the slot when the gate member is latched by said catch lever and said gate lever opens the slot to allow release of an object within the slot by pivoting outwardly away from the slot when unlatched by said catch lever, said gate member also opening into the slot and allowing insertion of an object into the slot by pivoting the gate member toward the slot; (e) said catch lever being pivotally supported on said body member on the opposite side of said slot from the pivot for said gate member;

(f) a first pivotable release means for controlling the rotation of said catch lever about its pivot, and a second pivotable release means for controlling the rotation of said first release means about its pivot, such that the gate member may only be unlatched when the second release means is pivoted first and then the first release means is pivoted

7. The release mechanism of claim 6 wherein the direction in which said release means are pivoted is towards the direction of the location of the object to be released.

8. The release mechanism of claim 6 comprising in addition, bias means for maintaining said gate member in contact with the catch lever when said gate member is in the latched position.

9. The mechanism of claim 8 wherein said bias means comprises an extension spring attached to the gate member and to the body member.

10. The mechanism of claim 9 comprising in addition means for attaching a cable to said body member at a position substantially opposite to the slot entrance.

* * * * *